US010690017B2

(12) United States Patent
Brown et al.

(10) Patent No.: US 10,690,017 B2
(45) Date of Patent: Jun. 23, 2020

(54) HYDRAULIC LASH ADJUSTER ASSEMBLY SLEEVES

(71) Applicant: Eaton Intelligent Power Limited, Dublin (IE)

(72) Inventors: Leon Brown, Pontiac, MI (US); James E. McCarthy, Jr., Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/386,437

(22) Filed: Apr. 17, 2019

(65) Prior Publication Data

US 2019/0242276 A1 Aug. 8, 2019

Related U.S. Application Data

(63) Continuation of application No. PCT/US2017/056842, filed on Oct. 17, 2017.

(60) Provisional application No. 62/409,084, filed on Oct. 17, 2016.

(51) Int. Cl.
*F01L 1/24* (2006.01)
*F01L 1/14* (2006.01)

(52) U.S. Cl.
CPC ..... *F01L 1/24* (2013.01); *F01L 1/146* (2013.01); *F01L 2001/2427* (2013.01); *F01L 2105/00* (2013.01); *F01L 2107/00* (2013.01); *F01L 2820/01* (2013.01)

(58) Field of Classification Search
CPC ..... F01L 1/14; F01L 2001/2427; F01L 1/245; F01L 2001/256; F01L 2105/00; F01L 2107/00
USPC ..... 123/90.35, 90.5, 90.52, 90.55
See application file for complete search history.

(56) References Cited

U.S. PATENT DOCUMENTS

| | | | | |
|---|---|---|---|---|
| 2,237,854 | A * | 4/1941 | Voorhies | F01L 1/252 123/90.55 |
| 5,263,386 | A | 11/1993 | Campbell et al. | |
| 6,435,150 | B1 * | 8/2002 | Loughlin | F01L 1/14 123/90.48 |
| 7,121,244 | B2 * | 10/2006 | Roe | F01L 1/146 123/90.5 |
| 8,851,038 | B1 * | 10/2014 | Iskenderian | F01L 1/146 123/90.33 |
| 2003/0070636 | A1 | 4/2003 | Evans et al. | |
| 2003/0145722 | A1 | 8/2003 | Albertson | |
| 2010/0000476 | A1 * | 1/2010 | Kunz | F01L 1/14 123/90.5 |
| 2010/0095916 | A1 | 4/2010 | Atzwanger et al. | |

(Continued)

OTHER PUBLICATIONS

International Search Report and Written Opinion for International Application No. PCT/US2017/056842 dated Jan. 31, 2018, 15 pages.

*Primary Examiner* — Jorge L Leon, Jr.
(74) *Attorney, Agent, or Firm* — RMCK Law Group PLC

(57) ABSTRACT

A hydraulic lash adjuster (HLA) sleeve configured to be received within a lifter bore of an engine block, includes a cylindrical sleeve having an outer surface defining an outer diameter, and an inner surface defining an inner diameter. The outer diameter is sized for an interference fit with the lifter bore to prevent rotation of the HLA sleeve within the lifter bore. The inner diameter is sized to receive a lifter.

17 Claims, 5 Drawing Sheets

(56) References Cited

U.S. PATENT DOCUMENTS

2017/0342868 A1* 11/2017 Ingram ..... F01L 1/245

* cited by examiner

HYDRAULIC LASH ADJUSTER ASSEMBLY SLEEVES

CROSS-REFERENCE TO RELATED APPLICATION

This application is a continuation of International Application No. PCT/US2017/056842 filed Oct. 17, 2017, which claims the benefit of U.S. Provisional Application No. 62/409,084, filed Oct. 17, 2016, the contents of which are incorporated herein by reference thereto.

FIELD

The present disclosure relates to a hydraulic lash adjuster assembly and, more particularly, to a set of sleeves that enable a hydraulic lash adjuster assembly to be used in multiple engine applications.

BACKGROUND

Some internal combustion engines can utilize rocker arms to transfer rotational motion of cams to linear motion appropriate for opening and closing engine valves. Deactivating rocker arms can incorporate hydraulic lash adjuster (HLA) mechanisms into a lifter bore of an engine block that allow for selective activation and deactivation of the rocker arm. However, the size of the lifter bores for the HLA mechanisms can vary across different types of engines, thus requiring specially sized HLA mechanisms for each size of lifter bore.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In one aspect of the present disclosure, a hydraulic lash adjuster (HLA) sleeve configured to be received within a lifter bore of an engine block is provided. The HLA sleeve includes a cylindrical sleeve having an outer surface defining an outer diameter, and an inner surface defining an inner diameter. The outer diameter is sized for an interference fit with the lifter bore to prevent rotation of the HLA sleeve within the lifter bore, and the inner diameter is sized to receive a lifter.

In addition to the foregoing, the described HLA sleeve may include one or more of the following features: wherein the inner surface includes a first flat configured to engage a second flat formed on the lifter to prevent rotation of the lifter within the HLA sleeve; an outer key extending outwardly from the outer surface, the outer key configured to be received by the engine block to prevent rotation of the HLA sleeve within the lifter bore; wherein the inner surface includes a flat; an inner key extending inwardly from the inner surface, the inner key configured to be received by the lifter to prevent relative rotation of the lifter within the HLA sleeve; an inner key extending inwardly from the inner surface, the inner key configured to be received by the lifter to prevent relative rotation of the lifter within the HLA sleeve; a hydraulic fluid port formed through the cylindrical sleeve and configured to supply hydraulic fluid to the lifter; and an annular groove formed in the inner surface and in fluid communication with the hydraulic fluid port, the annular groove configured to supply hydraulic fluid to the lifter.

In another aspect of the present disclosure, a set of hydraulic lash adjuster (HLA) sleeves configured to be received within a lifter bore of an engine block is provided. The set of HLA sleeves includes a first cylindrical sleeve having an outer surface defining a first outer diameter, and an inner surface defining a first inner diameter, and a second cylindrical sleeve having an outer surface defining a second outer diameter, and an inner surface defining a second inner diameter. The first outer diameter is larger than the second outer diameter. One of the first and second cylindrical sleeves is configured to be chosen from the set of HLA sleeves to fit into a corresponding sized lifter bore, and the first and second inner diameters are equal and are each configured to receive a same lifter.

In addition to the foregoing, the described set of HLA sleeves may include one or more of the following features: a third cylindrical sleeve having an outer surface defining a third outer diameter, and an inner surface defining a third inner diameter, wherein the second outer diameter is larger than the third outer diameter, wherein one of the first, second, and third cylindrical sleeves is configured to be chosen from the set of HLA sleeves to fit into a corresponding sized lifter bore, and wherein the first, second, and third inner diameters are equal and are each configured to receive a same lifter.

In addition to the foregoing, the described set of HLA sleeves may include one or more of the following features: wherein the inner surface of the first and second cylindrical sleeves includes a first flat configured to engage a second flat formed on the same lifter to prevent rotation of the same lifter within the first and second cylindrical sleeves; an outer key extending outwardly from the outer surface of each of the first and second cylindrical sleeves, the outer key configured to be received by the engine block to prevent rotation of the first or second cylindrical sleeves within the lifter bore; wherein the inner surface of the first and second cylindrical sleeves includes a flat; and an inner key extending inwardly from the inner surface of each of the first and second cylindrical sleeves, the inner key configured to be received by the same lifter to prevent relative rotation of the same lifter within the first and second cylindrical sleeves.

In addition to the foregoing, the described set of HLA sleeves may include one or more of the following features: an inner key extending inwardly from the inner surface of each of the first and second cylindrical sleeves, the inner key configured to be received by the same lifter to prevent relative rotation of the same lifter within the HLA sleeve; a hydraulic fluid port formed through each of the first and second cylindrical sleeves and configured to supply hydraulic fluid to the same lifter; and an annular groove formed in the inner surface of each of the first and second cylindrical sleeves, the annular groove in fluid communication with the hydraulic fluid port, the annular groove configured to supply hydraulic fluid to the same lifter.

In yet another aspect of the present disclosure, a hydraulic lash adjuster (HLA) assembly is provided. The HLA assembly is configured to be received within a lifter bore of an engine block, and includes a cylindrical HLA sleeve and a lifter. The cylindrical HLA sleeve includes an outer surface defining an outer diameter, and an inner surface defining an inner diameter. The outer diameter is sized for an interference fit with the lifter bore to prevent rotation of the HLA sleeve within the lifter bore. The lifter is disposed within the HLA sleeve, the HLA sleeve enabling the lifter with a diameter smaller than a diameter of the lifter bore to be operably disposed therein.

In addition to the foregoing, the described HLA assembly may include one or more of the following features: wherein the HLA sleeve is configured to be press-fit into the lifter bore to facilitate preventing rotation of the HLA sleeve within the lifter bore;

wherein the lifter includes a roller configured to interface with a cam.

In yet another aspect of the present disclosure, a method of assembling an internal combustion engine having a wall defining an oversized lifter bore is provided. The method includes providing a lifter having a diameter smaller than a diameter of the oversized lifter bore, determining a size of the oversized lifter bore, and selecting a hydraulic lash adjuster (HLA) sleeve to take up annular space between the lifter and the wall defining the oversized lifter bore to thereby secure the lifter within the oversized lifter bore.

In addition to the foregoing, the described method may include one or more of the following features: inserting the HLA sleeve into the oversized lifter bore; and inserting the lifter into the HLA sleeve.

BRIEF DESCRIPTION OF THE DRAWINGS

The present disclosure will become more fully understood from the detailed description and the accompanying drawings, wherein.

DETAILED DESCRIPTION

Figure 1:
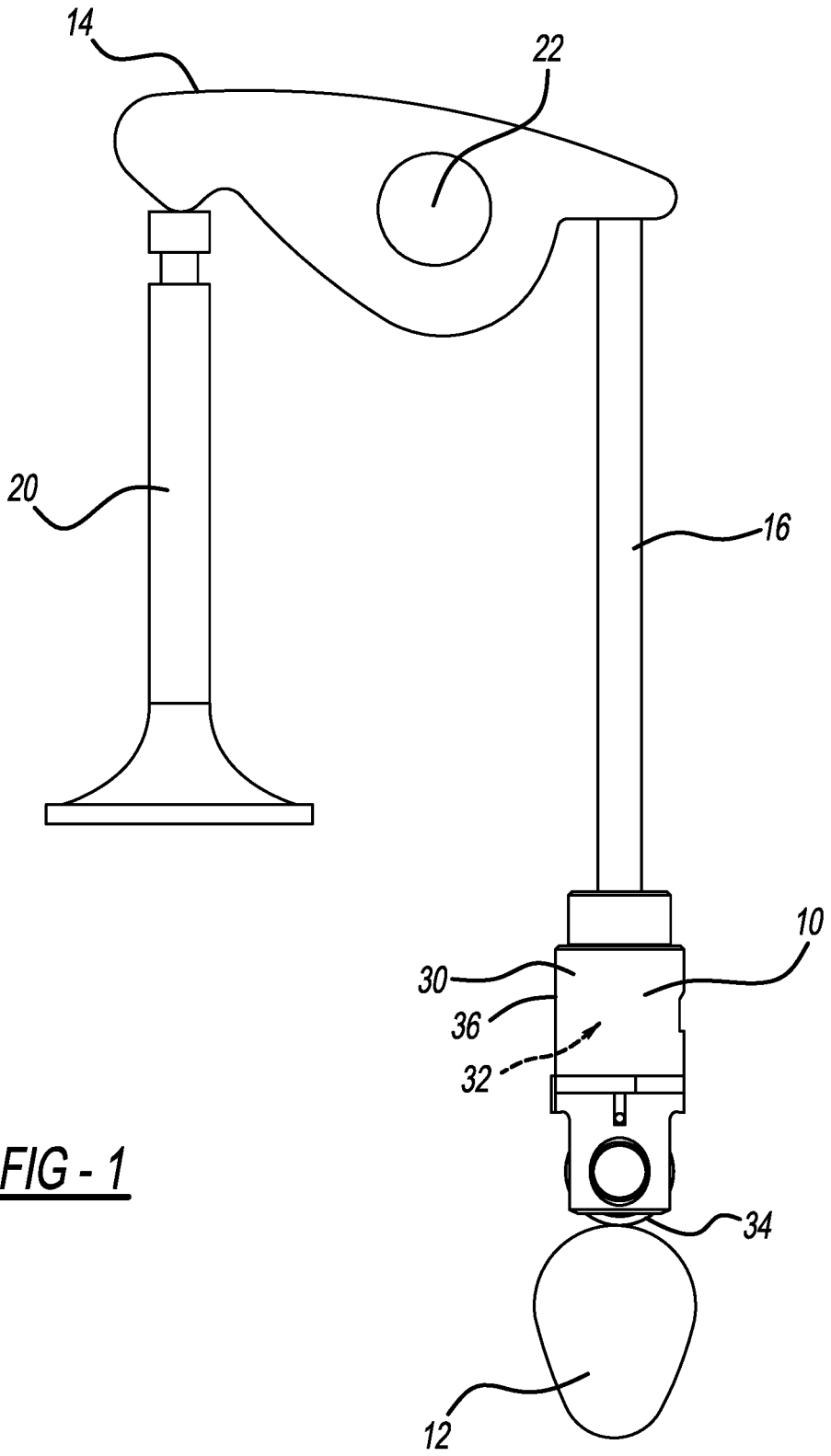
FIG. 1 is a roller lifter constructed in accordance to one example of the present disclosure and shown in an exemplary Type V valve train arrangement.

With initial reference to FIG. 1, a hydraulic lash adjuster (HLA) roller lifter constructed in accordance to one example of the present disclosure is shown and generally identified at reference number 10. Roller lifter 10 is shown as part of a Type V valve train arrangement. However, it will be appreciated that while shown in a Type V arrangement, it is within the scope of the present disclosure for the various features described herein to be used in other arrangements. In this regard, the features described herein associated with the valve train arrangement can be suitable to a wide variety of applications. A cam lobe 12 indirectly drives a first end of a rocker arm 14 with a push rod 16. It will be appreciated that in some configurations, such as an overhead cam, the roller lifter may be a direct link between the cam lobe 12 and the rocker arm 14. A second end of the rocker arm 14 actuates a valve 20. As the cam lobe 12 rotates, the rocker arm 14 pivots about a fixed shaft 22.

In the example implementation, the roller lifter 10 generally includes a body 30, a leakdown assembly 32 received within the body 30, and a roller bearing 34 rotatably mounted to the body 30. The body 30 includes an outer peripheral surface 36 configured for sliding movement in a lifter bore 40 provided in a cylinder head or engine block 42 of an internal combustion engine 44 (see FIG. 2B). As shown in FIGS. 2 and 3, roller lifter 10 is configured to be disposed within an HLA sleeve 50, which is configured for insertion into the lifter bore 40 formed in the engine block 42. In this way, HLA sleeve 50 can take up the annular space between roller lifter 10 and an oversized bore 40.

Figure 4:
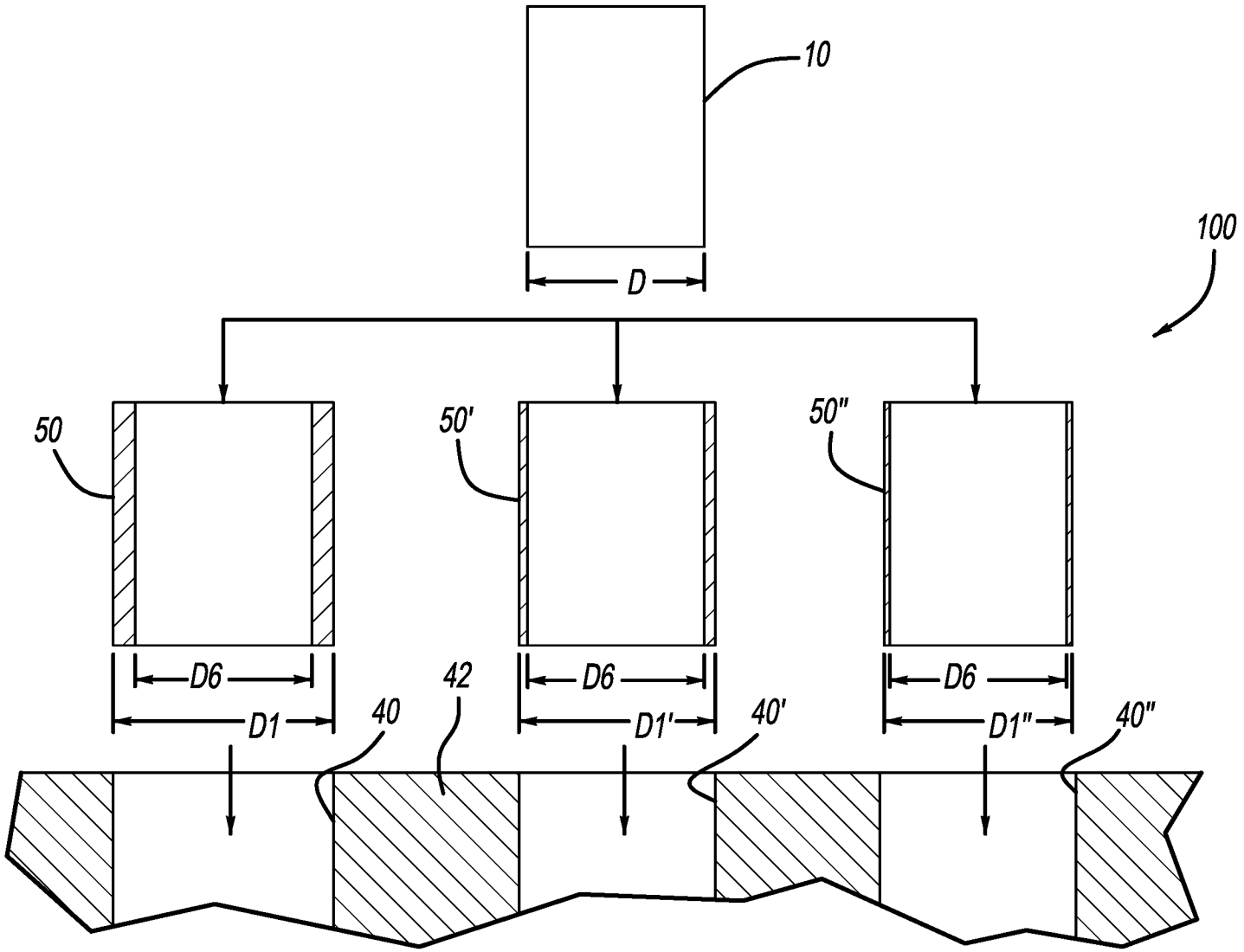
FIG. 4 illustrates a set of HLA sleeves in accordance to one example of the present disclosure.

Moreover, as shown in FIG. 4, HLA sleeve 50 may be part of a set 100 of HLA sleeves 50, 50', 50" each having the same inner diameter D6 to receive HLA roller lifter 10, but having different outer diameters (e.g., D1, D1', D1"). As illustrated, D1 is greater than D1', which is greater than D1". This enables the same roller lifter 10 to be installed into lifter bores (e.g., 40, 40', 40") having various diameters by selecting from the different sized HLA sleeves 50. As illustrated, the diameter of bore 40 is greater than the diameter of bore 40', which is greater than the diameter of bore 40". As such, a new roller lifter does not need to be designed and sized for each of the various sized lifter bores 40 that occur across multiple engine platforms.

Figure 2A:
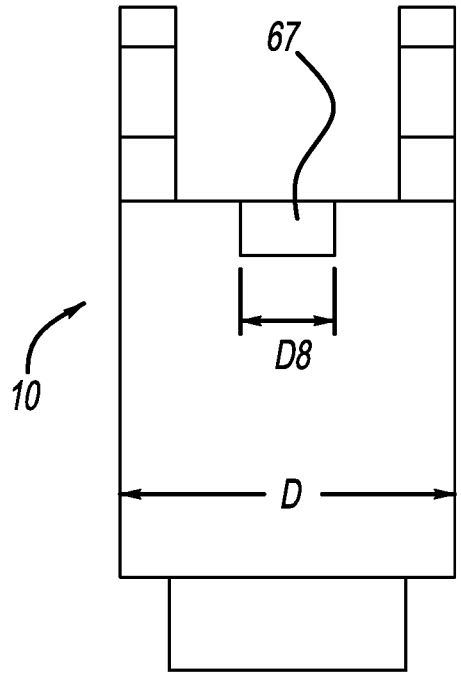
FIG. 2A is a roller lifter constructed in accordance to one example of the present disclosure.
Figure 2B:
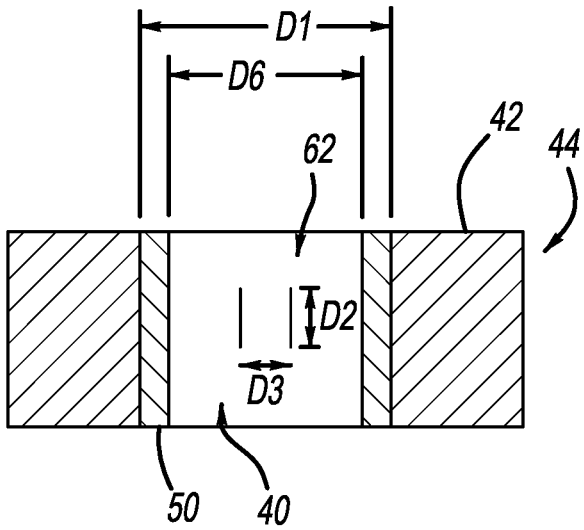
FIG. 2B is a cross-sectional view of an exemplary hydraulic lash adjuster (HLA) sleeve constructed in accordance to one example of the present disclosure and shown received in an exemplary engine block.
Figure 2C:
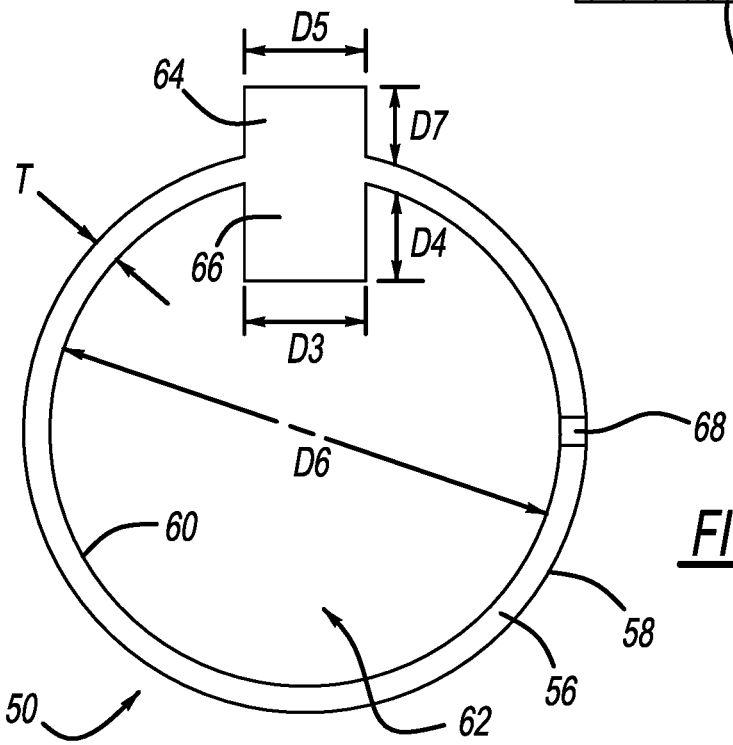
FIG. 2C is a top view of the HLA sleeve of FIG. 2B.
Figure 3:
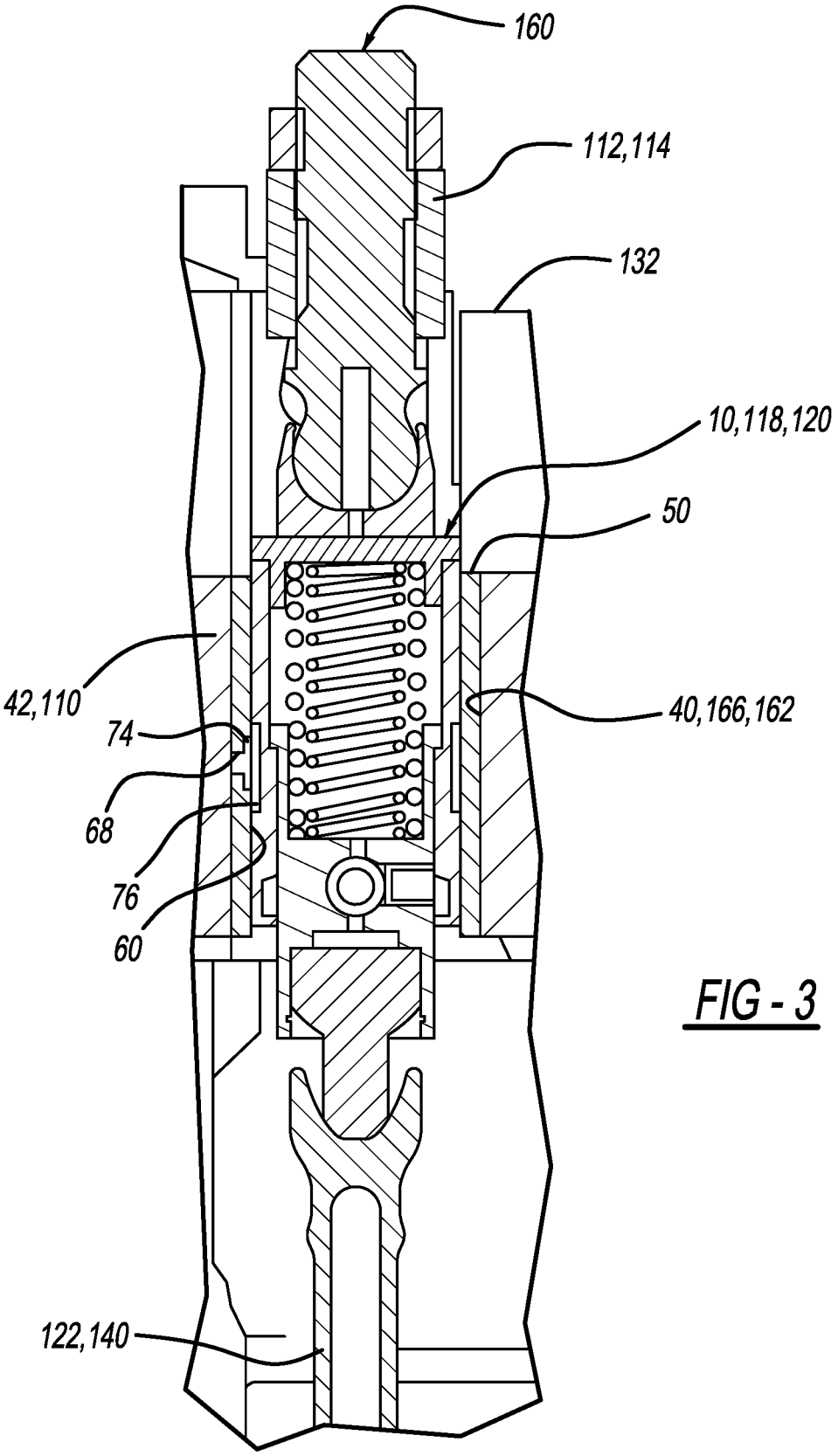
FIG. 3 is a cross-sectional view of a valve train arrangement having the HLA sleeve shown in FIG. 1, in accordance to one example of the present disclosure.

As illustrated in FIGS. 2A-2C, each HLA sleeve 50 includes a cylindrical or generally cylindrical wall or sleeve 56 having a thickness 'T', an outer surface 58 defining outer diameter D1 (FIG. 2B), and an inner surface 60 defining inner diameter D6. Inner surface 60 defines a receiving aperture 62 to receive HLA roller lifter 10. Thickness 'T' is defined such that outer diameter D1 is equal to or slightly larger than a diameter of bore 40, thereby ensuring an interference fit between HLA sleeve 50 and lifter bore 40 to facilitate preventing rotation of HLA sleeve 50 within lifter bore 40. As such, an HLA sleeve 50 is selected with dimensions to take up the size difference between the lifter bore 40 and the roller lifter 10.

In one arrangement shown in FIGS. 2A-2C, HLA sleeve 50 can include an outer key 64 and an inner key 66. Outer key 64 is configured to be received within a slot (not shown) formed within lifter bore 40 to thereby prevent rotation of HLA sleeve 50 within lifter bore 40. As shown in FIG. 2C, outer key 64 can have a width D5 and a depth D7. Inner key 66 is configured to be received within a slot 67 formed in roller lifter 10 to thereby prevent rotation of roller lifter 10 within HLA sleeve 50. As shown in FIGS. 2A-2C, inner key 66 can have a height D2, a width D3, and a depth D4, and roller lifter slot 67 can have a width D8. In one example, width D8 is equal to or slightly larger than width D3.

Figure 5:
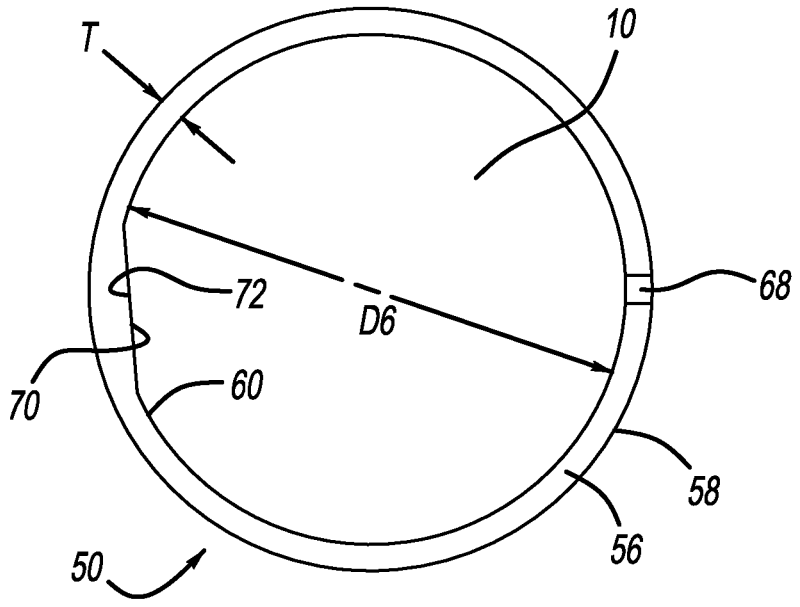
FIG. 5 is a top view of an HLA sleeve and lifter in accordance to one example of the present disclosure.

In alternative arrangements, rather than having keys 64, 66, HLA sleeve 50 may be press-fit into bore 40 and can include an inner flat 70 (e.g., a flat surface) formed on inner surface 60 (see FIG. 5). The inner flat 70 is configured to engage a lifter flat 72 (e.g., a flat surface formed on lifter 10 to thereby prevent rotation of lifter 10 within HLA sleeve 50. This enables HLA sleeve 50 to prevent rotation of lifter 10 without having to alter the round lifter bore 40 (e.g., forming shapes or flats in the bore 40). Moreover, sleeve outer surface 58 may be formed with a rough texture to facilitate gripping the wall of lifter bore 40 and preventing rotation of HLA sleeve 50.

In other examples, HLA sleeve 50 and/or roller lifter 10 may have other complementary shapes or geometries configured to prevent rotation of roller lifter 10 within HLA sleeve (e.g., spheres, slots, etc.). In this regard, the HLA sleeve 50 may have a first engaging structure therein (such as on an inner surface) and the roller lifter 10 may have a complementary second engaging structure thereon (such as on an outer surface) for mating with the first engaging structure. The first and second engaging structures can be keyed or mated to inhibit or preclude relative rotation of the roller lifter 10 within the HLA sleeve 50. The first and second engaging structures can comprise any suitable complementary geometries such as concave depressions and convex extensions, slots and grooves, and other configurations.

One example method of assembling an internal combustion engine 44 includes providing an engine block 42 with at least one oversized bore 40. An HLA roller lifter 10 is provided having a predetermined diameter 'D' that is smaller than the diameter of the oversized bore. The size of bore 40 is determined, and one HLA sleeve 50 is selected from a set of HLA sleeves to take up the annular space between the roller lifter 10 and the wall defining lifter bore 40. The selected HLA sleeve 50 is chosen having an outer diameter D1 equal to or slightly greater than the diameter of the lifter bore 40. The HLA sleeve 50 is inserted (e.g., press-fit) into lifter bore 40, and roller lifter 10 is subsequently inserted into the selected HLA sleeve 50. Alternatively, roller lifter 10 may be inserted into HLA sleeve 50, and sleeve 50 is subsequently inserted into lifter bore 40.

In one implementation, HLA sleeve 50 is fabricated with an interference fit with lifter bore 40 of 0.0025" or approximately 0.0025" when engine block 42 is fabricated from cast iron. In another implementation, HLA sleeve 50 is fabricated with an interference fit with bore 40 of 0.004" or approximately 0.004" when engine block 42 is fabricated from aluminum.

In one implementation, the HLA sleeve set includes three HLA sleeves 50 having thicknesses 'T' of 1/16", 3/32", and 1/8". In other implementations, the thicknesses 'T' are approximately 1/16", approximately 3/32", and approximately 1/8". Accordingly, this enables one HLA sleeve 50 of the set of sleeves 100 to fit within various sized lifter bores 40 of varied engines 44 while maintaining the strength of the engine blocks 42. In one implementation, roller lifter 10 has a diameter of between 24 mm and 40 mm or between approximately 24 mm and approximately 40 mm. In another implementation, roller lifter 10 has a diameter of between 26 mm and 32 mm or between approximately 26 mm and approximately 32 mm. However, it will be appreciated that thickness 'T', outer diameter D1, inner diameter D6 may have any suitable size to accommodate various sized roller lifters 10 and lifter bores 40.

Moreover, HLA sleeve 50 may include one or more oil channel or feed 68 (FIG. 2) configured to supply oil or other hydraulic fluid from a source to the roller lifter 10. Additionally, as shown in FIG. 3, sleeve inner surface 60 may include an annular groove 74 formed therein and in fluid communication with the hydraulic fluid feed 68. The annular groove 74 can be configured to supply hydraulic fluid to the lifter 10 via a groove 76, and can extend around the entirety or only a portion of the circumference of sleeve inner surface 60.

In some examples, HLA sleeve 50 is fabricated from a centrifugally spun cast iron alloy of carbon-chrome and molybdenum featuring high tensile strength of 48,000 psi to 53,000 psi. Alternatively, HLA sleeve 50 may be fabricated from plastic, ductile iron, HSS steel stamping, hydroformed tubing, or any other suitable material/process that enables HLA sleeve 50 to function as described herein.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A set of hydraulic lash adjuster (HLA) sleeves configured to be received within a lifter bore of an engine block, the set of HLA sleeves comprising:

at least two cylindrical sleeves each having an inner surface with a common inner diameter and an outer surface with distinct outer diameters, wherein a selected sleeve is chosen from the at least two cylindrical sleeves based on a size of the lifter bore;

wherein the outer diameter of the selected sleeve is sized for an interference fit with the lifter bore so as to prevent rotation of the selected sleeve within the lifter bore; and wherein the inner diameter is sized to receive a lifter.

2. The set of HLA sleeves of claim 1, wherein each inner surface includes a first flat configured to engage a second flat formed on the lifter so as to prevent rotation of the lifter within the selected sleeve.

3. The set of HLA sleeves of claim 1, further comprising an outer key extending outwardly from each outer surface, wherein the outer key of the selected sleeve is configured to be received by the engine block so as to prevent rotation of the selected sleeve within the lifter bore.

4. The set of HLA sleeves of claim 1, wherein each inner surface includes a flat.

5. The set of HLA sleeves of claim 3, further comprising an inner key extending inwardly from each inner surface, wherein the inner key of the selected sleeve is configured to be received by the lifter so as to prevent relative rotation of the lifter within the selected sleeve.

6. The set of HLA sleeves of claim 1, further comprising an inner key extending inwardly from the inner surface, wherein the inner key of the selected sleeve is configured to be received by the lifter so as to prevent relative rotation of the lifter within the selected sleeve.

7. The set of HLA sleeves of claim 1, further comprising a hydraulic fluid port formed through each cylindrical sleeve and configured to supply hydraulic fluid to the lifter.

8. The set of HLA sleeves of claim 7, wherein each hydraulic fluid port is in fluid communication with a respective annular groove formed in each inner surface such that each annular groove is configured to supply the hydraulic fluid to the lifter.

9. A set of hydraulic lash adjuster (HLA) sleeves configured to be received within a lifter bore of an engine block, the set of HLA sleeves comprising:

a first cylindrical sleeve having a first outer surface defining a first outer diameter, and a first inner surface defining a first inner diameter;

a second cylindrical sleeve having a second outer surface defining a second outer diameter, and a second inner surface defining a second inner diameter; and wherein the first outer diameter is larger than the second outer diameter, wherein one of the first and second cylindrical sleeves is configured to be chosen from the set of HLA sleeves based on a size of the lifter bore so as to form an interference fit when inserted in the lifter bore, and wherein the first inner diameter is equal to the second inner diameter such that a lifter is received by the first inner surface or the second inner surface.

10. The set of HLA sleeves of claim 9, wherein each inner surface includes a first flat configured to engage a second flat formed on the lifter so as to prevent rotation of the lifter within the first or second cylindrical sleeve.

11. The set of HLA sleeves of claim 9, wherein each outer surface includes an outwardly extending outer key configured to be received by the engine block so as to prevent rotation of the first or second cylindrical sleeve within the lifter bore.

12. The set of HLA sleeves of claim 9, wherein each inner surface includes a flat.

13. The set of HLA sleeves of claim 11, wherein each inner surface includes an inwardly extending inner key configured to be received by the lifter so as to prevent relative rotation of the lifter within the first or second cylindrical sleeve.

14. The set of HLA sleeves of claim 9, wherein each inner surface includes an inwardly extending inner key configured to be received by the lifter so as to prevent relative rotation of the lifter within the first or second cylindrical sleeve.

15. The set of HLA sleeves of claim 9, further comprising a hydraulic fluid port formed through each of the first and second cylindrical sleeves and configured to supply hydraulic fluid to the lifter.

16. The set of HLA sleeves of claim 15, wherein each hydraulic fluid port is in fluid communication with a respective, annular groove formed in each inner surface, such that each annular groove is configured to supply the hydraulic fluid to the lifter.

17. A set of hydraulic lash adjuster (HLA) sleeves configured to be received within a lifter bore of an engine block, the set of HLA sleeves comprising:

a first cylindrical sleeve having a first outer surface defining a first outer diameter, and a first inner surface defining a first inner diameter;

a second cylindrical sleeve having a second outer surface defining a second outer diameter, and a second inner surface defining a second inner diameter;

a third cylindrical sleeve having a third outer surface defining a third outer diameter and a third inner surface defining a third inner diameter;

wherein the first, second and third outer diameters are distinct, wherein one of the first, second or third cylindrical sleeves is configured to be chosen from the set of HLA sleeves based on a size of the lifter bore so as to form an interference fit when inserted in the lifter bore; and wherein the first, second and third inner diameters are equal to each other such that a lifter is received by the first, second or third inner surface.

* * * * *